US005216214A

United States Patent [19]

Willieme et al.

[11] Patent Number: 5,216,214

[45] Date of Patent: Jun. 1, 1993

[54] HIGH- AND MEDIUM-VOLTAGE GAS BLAST CIRCUIT BREAKER

[75] Inventors: Jean-Marc Willieme, La Mulatiere; Francois Biquez, Brignais, both of France

[73] Assignee: GEC Alsthom SA, Paris, France

[21] Appl. No.: 886,146

[22] Filed: May 21, 1992

[30] Foreign Application Priority Data

May 23, 1991 [FR] France ..... 91 06214

[51] Int. Cl.[5] ..... H01H 33/88

[52] U.S. Cl. ..... 200/148 A; 200/148 B; 200/150 G

[58] Field of Search ..... 200/148 R, 148 A, 148 B, 200/150 G

[56] References Cited

U.S. PATENT DOCUMENTS 3,858,015 12/1974 Deno ..... 200/148 B
4,565,911 1/1986 Slamecka ..... 200/148 A
4,939,322 7/1990 Kashimura et al. ..... 200/148 A

FOREIGN PATENT DOCUMENTS 2377695 8/1978 France .

*Primary Examiner*—J. R. Scott
*Attorney, Agent, or Firm*—Sughrue, Mion, Zinn Macpeak & Seas

[57] ABSTRACT

A gas blast circuit breaker comprises a cylindrical metal or insulative enclosure filled with pressurized insulative gas, a fixed arc contact and a mobile assembly coupled to an operating member comprising a gas blast cylinder associated with a gas blast nozzle and cooperating with a piston, and a mobile arc contact carried by a tubular member inside the gas blast cylinder. The inside wall of the tubular member comprises a bottleneck whose cross-section is less than the inside cross-section of the tubular member and coaxial therewith. The minimum cross-section of the bottleneck has a diameter less than or equal to the diameter of the inside cross-section of the mobile arc contact and equal to at least 0.75 times the diameter of the inside cross-section of the mobile arc contact. The operation of the circuit breaker is improved by increasing the gas pressure near the mobile arc contact by virtue of a particularly simple and low-cost arrangement.

4 Claims, 1 Drawing Sheet

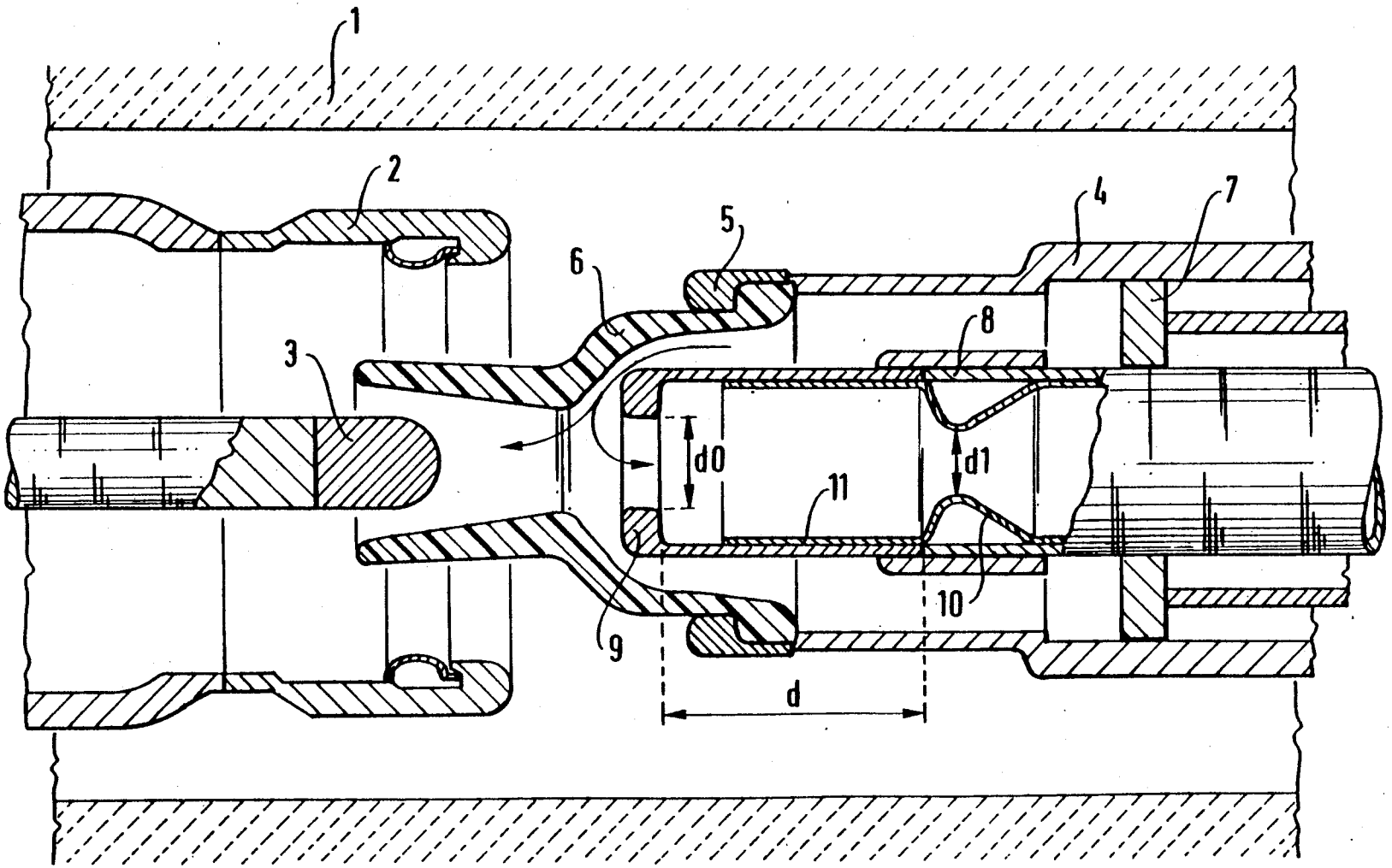
1
2
3
4
5
6
7
8
9
10
11
d1
d0
d

HIGH- AND MEDIUM-VOLTAGE GAS BLAST CIRCUIT BREAKER

BACKGROUND OF THE INVENTION

1. Field of the Invention

The present invention concerns a high- and medium-voltage gas blast circuit breaker comprising a cylindrical metal or insulative enclosure filled with pressurized insulative gas, a fixed arc contact and a mobile assembly coupled to an operating member comprising a gas blast cylinder associated with a gas blast nozzle and cooperating with a piston, and a mobile arc contact carried by a tubular member inside the gas blast cylinder.

2. Description of the Prior Art

Circuit breakers of the above type are known.

The tubular member carrying the mobile arc contact often has lateral openings to obtain a double gas blast effect in the sense that the pressurized gas in the annular space between the gas blast cylinder and the tubular member supporting the mobile arc contact is blown inside the gas blast nozzle and also towards the interior of the mobile arc contact and therefore towards the interior of the tubular member supporting it.

An object of the present invention is to.improve the operation of a circuit breaker of this kind and in particular of thermal expansion circuit breakers using the energy of the arc by increasing the gas pressure near the mobile arc contact by means of a particularly simple and low-cost arrangement.

SUMMARY OF THE INVENTION

The present invention consists in a gas blast circuit breaker comprising a cylindrical metal or insulative enclosure filled with pressurized insulative gas, a fixed arc contact and a mobile assembly coupled to an operating member comprising a gas blast cylinder associated with a gas blast nozzle and cooperating with a piston, and a mobile arc contact carried by a tubular member inside the gas blast cylinder, in which circuit breaker the inside wall of said tubular member comprises a bottleneck whose cross-section is less than the inside cross-section of the tubular member and coaxial therewith, the minimum cross-section of the bottleneck having a diameter less than or equal to the diameter of the inside cross-section of the mobile arc contact and equal to at least 0.75 times the diameter of the inside cross-section of the mobile arc contact.

By virtue of this arrangement, the pressure of the insulative gas entering the tubular member is increased and the gas blast is improved. In this way it is possible to increase the insulative gas pressure up to 25%.

To enable a choice of bottleneck cross-section the distance between the mobile arc contact and the bottleneck is preferably slightly greater than the length of the fixed arc contact inside the tubular member in the tripped position.

The bottleneck may be in the form of an attached separate part.

In the case of a circuit breaker comprising a protective insulative or tubular metal lining on the inside wall of the tubular member, the bottleneck is preferably a deformed part of said lining.

The invention is described in more detail hereinafter with reference to a drawing showing one embodiment of the invention.

BRIEF DESCRIPTION OF THE DRAWING

The single FIGURE is a partial view of a circuit breaker in longitudinal cross-section.

DETAILED DESCRIPTION OF THE INVENTION

The cylindrical insulative enclosure 1 filled with insulative gas, usually $SF_6$, accommodates:

- a fixed permanent contact 2,
- a fixed arc contact 3,
- a mobile assembly comprising a gas blast cylinder 4 carrying a mobile permanent contact 5, a gas blast nozzle 6, a gas blast piston 7 and a coaxial tubular member 8 inside the cylinder 4 and carrying a mobile arc contact 9.

The mobile assembly is shown in the open position and the gas is blown by the piston 7 in the direction of the arrows into the gas blast nozzle 6 and into the tubular member 8 carrying the mobile arc contact 9.

The gas is then discharged through at least one aperture provided near the end of the tubular member 8 that is not shown.

The tubular member 8 is provided near the contact 9 with a bottleneck formed by a deformed portion 10 of the metal tube 11, usually a steel tube, protecting the tubular member 8 against the high temperature.

This portion 10 is deformed symmetrically with respect to the longitudinal axis of the tubular member 11 is at a distance d from the mobile arc contact 9 which is preferably slightly greater than the length of the fixed arc contact 3 inserted in the mobile arc contact 9 in the tripped condition of the circuit breaker.

Preferably:

$$0.75\, d_0 \leqq d_1 \leqq d_0$$

$d_0$ being the diameter of the inside cross-section of the mobile arc contact 9 and $d_1$ being the minimum diameter of the bottleneck flow cross-section.

This structural arrangement has the advantage of producing a pressure rise. To be more precise, it is in this way possible to increase the density of the gas around the mobile contact 9 up to 25%, providing improved dielectric strength when interrupting low capacitive currents at this contact 9. If the diameter of the bottleneck is less than 0.75 $d_0$, the bottleneck is deleterious with high currents which require a sufficient flow cross-section in at least the tubular member 8 to ensure the gas blast effect and de-ionization of the space between the contacts 3 and 9.

The FIGURE shows a preferred shape of the bottleneck providing optimum gas flow conditions.

The bottleneck can be of any biconical or other shape.

In an alternative embodiment the bottleneck may be obtained by attaching a separate part to the inside wall of the member 8 supporting the mobile arc contact 9. This part may be made from metal, for example steel, or an insulative material, for example PTFE.

The invention applies to conventional type high-voltage circuit breakers of the insulative or grounded metal enclosure type.

We claim:

1. Gas blast circuit breaker comprising a cylindrical metal or insulative enclosure filled with pressurized insulative gas, a fixed arc contact and a mobile assembly coupled to an operating member comprising a gas blast cylinder associated with a gas blast nozzle and cooperating with a piston, and a mobile arc contact carried by a tubular member inside the gas blast cylinder, in which circuit breaker the inside wall of said tubular member comprises a bottleneck whose cross-section is less than the inside cross-section of the tubular member and coaxial therewith, the minimum cross-section of the bottleneck having a diameter less than or equal to the diameter of the inside cross-section of the mobile arc contact and equal to at least 0.75 times the diameter of the inside cross-section of the mobile arc contact.

2. Circuit breaker according to claim 1 wherein the distance between said mobile arc contact and said bottleneck is slightly greater than the length of said fixed arc contact inside said tubular member in a tripped configuration of the circuit breaker.

3. Circuit breaker according to claim 1 wherein said bottleneck is an attached separate part.

4. Circuit breaker according to claim 1 comprising a protective insulative or tubular metal lining on the inside wall of said tubular member and wherein said bottleneck is a deformed portion of said lining.

* * * * *